United States Patent [19]

Benedick

[11] 4,302,426

[45] Nov. 24, 1981

[54] THERMAL REGENERATION OUTLET BY-PASS SYSTEM

[75] Inventor: Edward H. Benedick, Morristown, N.J.

[73] Assignee: Regenerative Environmental Equipment Co., Inc., Morris Plains, N.J.

[21] Appl. No.: 55,908

[22] Filed: Jul. 9, 1979

[51] Int. Cl.[3] ..... F01N 3/10

[52] U.S. Cl. ..... 422/173; 110/190; 110/203; 110/212; 422/170; 422/176; 422/241

[58] Field of Search ..... 422/170, 173, 175, 176, 422/181, 241; 110/190, 203, 210, 212

[56] References Cited

U.S. PATENT DOCUMENTS

| | | | |
|---|---|---|---|
| 2,991,160 | 7/1961 | Claussen | 422/173 X |
| 3,086,353 | 4/1963 | Ridgway | 422/173 X |
| 3,167,400 | 1/1965 | Fisher | 422/173 |
| 3,172,251 | 3/1965 | Johnson | 422/175 X |
| 3,211,534 | 10/1965 | Ridgway | 422/173 X |
| 3,214,246 | 10/1965 | Ridgway | 422/175 X |
| 3,895,918 | 7/1975 | Mueller | 422/175 |
| 4,125,593 | 11/1978 | Scheifley et al. | 422/241 X |

*Primary Examiner*—Richard L. Chiesa
*Attorney, Agent, or Firm*—Nelson E. Kimmelman

[57] ABSTRACT

In a thermal regeneration anti-pollution system in which there are a plurality of heat-exchange beds communicating with a high temperature incineration zone, excessive temperatures in the zone and danger to equipment in the installation are prevented by drawing off at least part of the hot gases therein. The gases are by-passed around the heat-exchange bed through which they would normally flow and then mixed in the exhaust with those incinerated gases which have been cooled through their normal passage through a heat-exchange bed.

14 Claims, 7 Drawing Figures

FAN OUTLET
FAN INLET
3
3
4
4
13
14
12
39
34
34a
36
35
32
37
38
38a
25
30
20
41
29
28

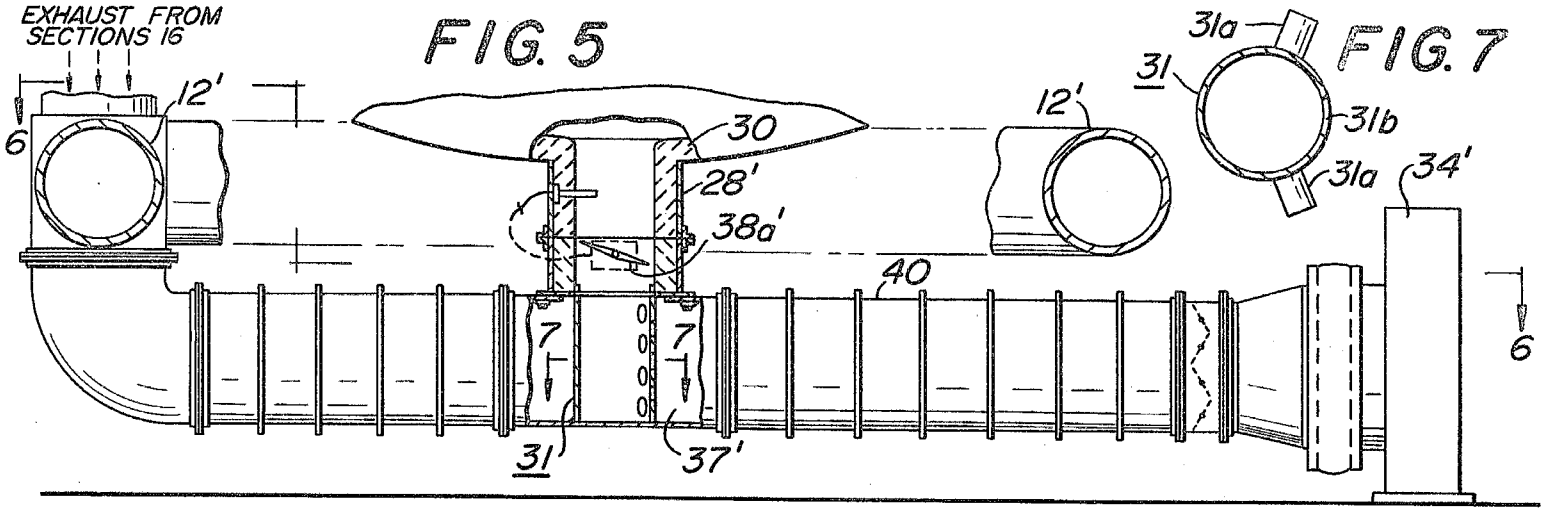
FIG. 7
FIG. 5
EXHAUST FROM SECTIONS 16
12'
6
31
31a
31b
34'
12'
40
30
28'
38a'
37'
7
7
31
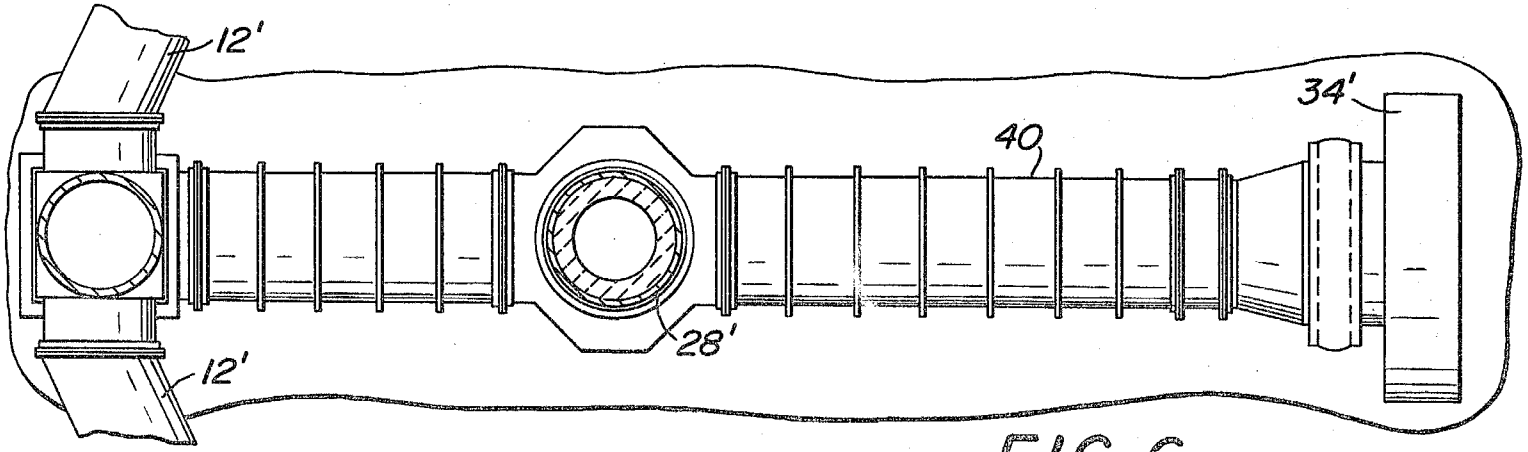
FIG. 6
34'
40
28'
12'
12'

THERMAL REGENERATION OUTLET BY-PASS SYSTEM

BACKGROUND OF THE INVENTION

1. Field of the Invention

This invention relates to anti-pollution apparatus and, in particular to improved thermal regeneration incineration systems.

2. Prior Art

Thermal regeneration equipment is known which comprises a plurality of heat-exchange beds or chambers in communication with a high temperature after-burner zone such as is shown in U.S. Pat. No. 3,895,918 to James Mueller. The exhaust gas from a factory, for example, is purified by passing through a first inlet bed into a high-temperature incinerator or after-burner zone where noxious or other undesired components are burned off or converted to less harmful substances. The heat-consumed gases are drawn from the high temperature zone through a second heat-exchange bed whose elements are thereby heated considerably.

Some of the exhaust fumes and gases fed to such thermal regeneration apparatus from the industrial process include chemicals such as solvents which, when ignited in the high temperature combustion zone, raise its temperature to excessive levels. Such elevated temperatures can be harmful to the valves, fans and other heat-sensitive equipment in the installation.

In certain known incinerators having heat-exchangers, the temperature of the combustion zone has been monitored so that when it starts to approach dangerously high temperature levels, the exhaust fumes to be purified are made to by-pass the inlet heat-exchange and go directly to the combustion zone. Since the temperature of the industrial effluent may be at approximately ambient temperature, for example, it arrives at the combustion chamber in a relatively cool state. Furthermore, known incinerators are often designed so that the retention or dwell time of the effluent in that zone may be quite short, i.e., on the order of 0.5 seconds. These two factors, the low temperature of the input gas and the short dwell time, co-act so that the noxious fumes are not adequately combusted and, therefore, the exhaust gases are not purified to the desired extent.

If, in such a case it is desired to compensate for those low-temperature input gases directly into the combustion zone where they will dwell for a short time, by raising the temperature in the zone by a considerable amount, this would result in a dangerous operating condition.

It is therefore among the objects of the present invention to provide an improved system for preventing the generation of excessively high temperatures in the combustion zone so as to avoid harmful effects on the associated equipment and personnel.

It is also among the objects of the invention to provide for continuous operation of a thermal regeneration system with satisfactory purification efficiency.

Another object is to permit the apparatus to be smaller than would otherwise be the case.

SUMMARY OF THE INVENTION

In a thermal regeneration system in which a gas is normally first passed through a hot heat-exchange bed into a communicating high temperature incineration chamber and then through a relatively cool second heat exchange bed to exhaust, a system for controlling the upper temperature of said chamber which extracts a predetermined amount of the hot gases from said chamber and applies them directly to exhaust thereby bypassing said second chamber.

BRIEF DESCRIPTION OF THE DRAWINGS

FIG. 5 is a fragmentary elevation view, partly cut away and partly in section, of an alternative form of the present invention.

FIG. 6 is a fragmentary plan view, partly in section, of still another form of the invention.

FIG. 7 is a sectional view taken along section line 7—7 of FIG. 5 in the direction indicated.

DETAILED DESCRIPTION OF THE DRAWINGS

Figure 1:
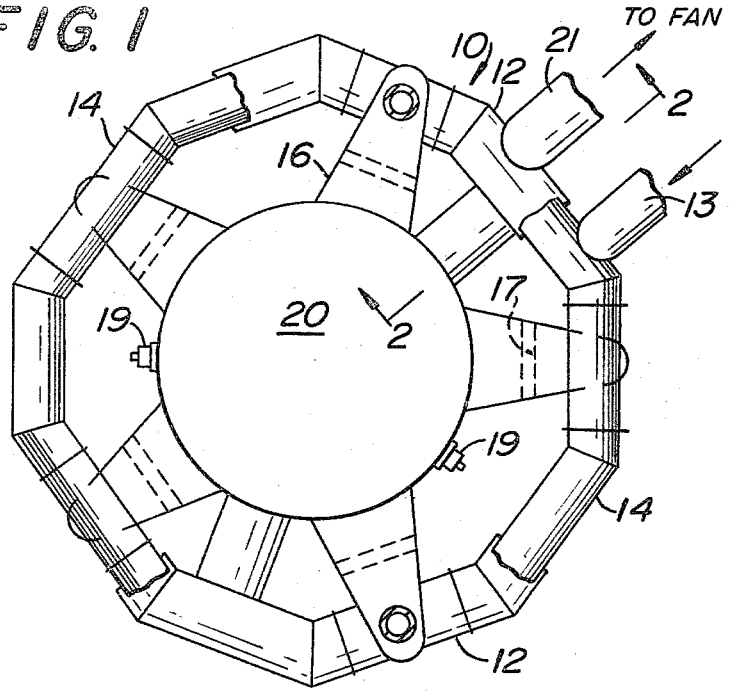
FIG. 1 is primarily a schematic plan view of a typical environment in which the present invention may be employed.

FIG. 1 shows the overall arrangement of a thermal regeneration incinerating system. The particular one shown comprises five heat-exchange sections 16. They are arranged equiangularly about a central high temperature combustion or incineration zone or chamber 20 heated by a burner 19 with which they communicate. In each section 16 there is a bed 17 of heat-exchanging refractory elements. There is an upper inlet duct ring 14 to which the incoming noxious gas to be purified is applied via inlet duct 13 from the exhaust of an industrial process, for example. The incoming gas, denoted by solid arrows, passes into ring 14 and then via ducts 15 through selected valves (not shown) into selected ones of the sections 16. In those sections 16, the gas is sucked through the associated ones of the exchange beds 17. As described in the aforementioned Mueller patent, the heat-exchange elements ("stones") may be of a ceramic refractory material having a saddle shape or other shape designed to maximize the available solid-gas interface area. The heat-exchange elements are contained between the perforated walls **17*a* and 17*b*. The wall 17*a* being closer to the high heat of the combustion chamber 20 is therefore considerably hotter than the outer perforated wall 17*b*. This fact, plus the fact that when a particular heat-exchange section 16 changes in its cycle from being an inlet heat-exchanger to an outlet heat-exchanger, results in the production of a temperature gradient from front to back of the beds 17. When the purified gas leaves chamber 20 it loses most of its heat as an exhaust fan draws it through selected ones of the sections 16 acting as output heat exchangers. The cooled, purified gas then enters the exhaust duct ring 12 which communicates with the exhaust fan 34 via duct 21**.

If a particular section 16 has just changed cycle from an outlet to an inlet section, the incoming fumes are preheated as they pass through the hot stones. They therefore arrive at the combustion chamber at a much higher than ambient temperature. If the incoming fumes contain solvents, combustion of the solvents in the central zone causes additional elevation of the gas temperature in chamber 20. Whereas, for a given input of 10,000 cubic feet of ambient air per minute at 85% efficiency would yield 2,500,000 BTU, the addition of solvents into the input can produce heat well in excess of this amount. Such excessive heat is dangerous and harmful, both to the equipment such as fans, ducts, valves and other equipment.

Figure 4:
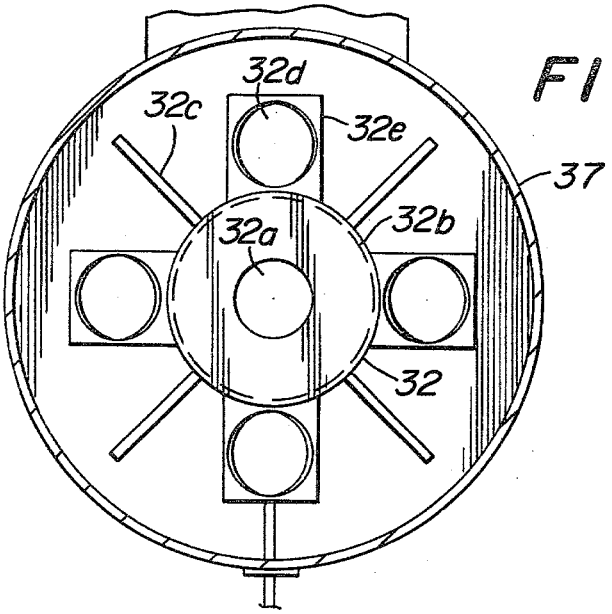
FIG. 4 is a sectional view taken along the section line 4—4 in FIG. 2 in the direction indicated.
Figure 2:
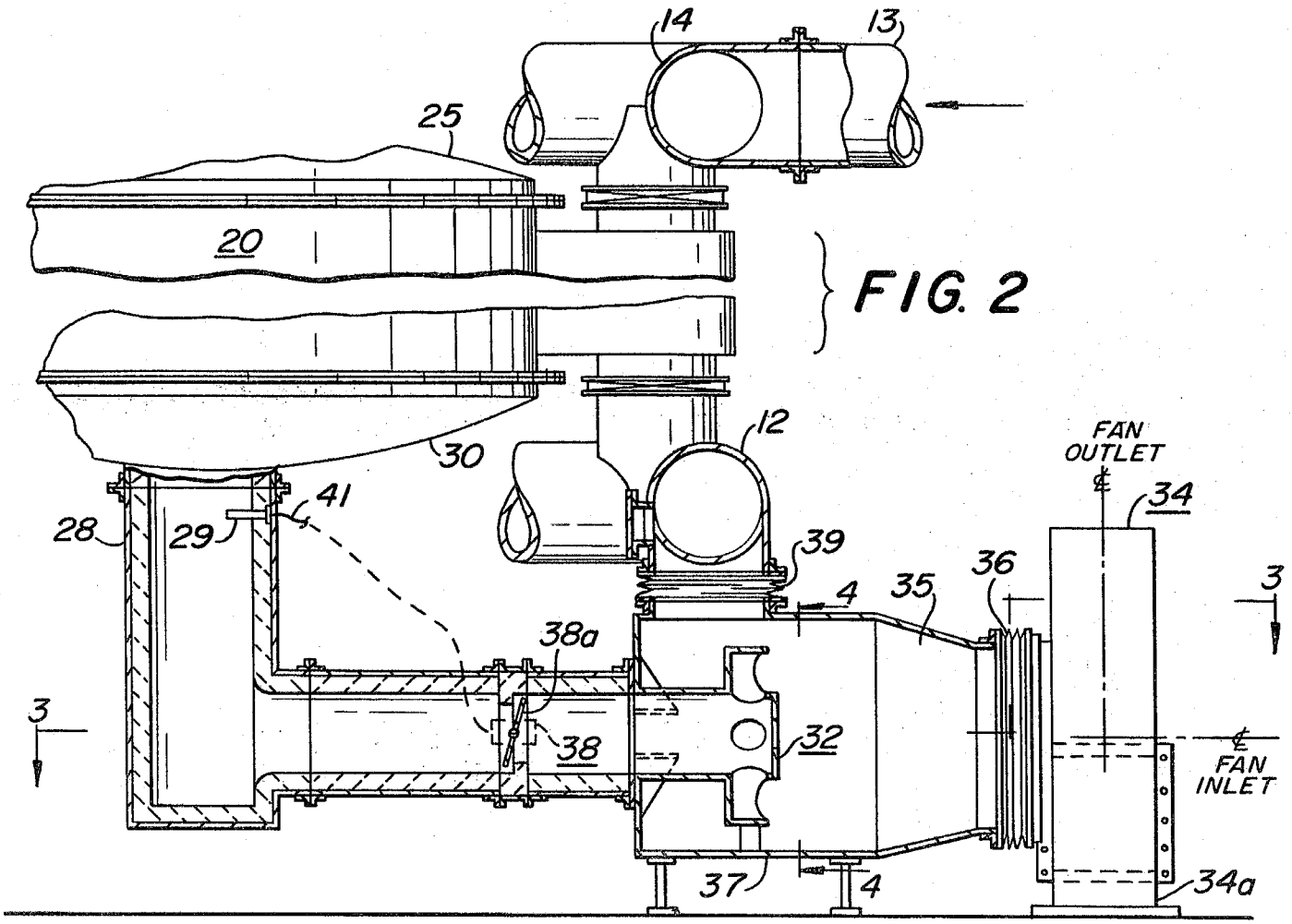
FIG. 2 is a sectional view of part of the apparatus shown in FIG. 1 taken along the section line 2—2 therein in the direction indicated.
Figure 3:
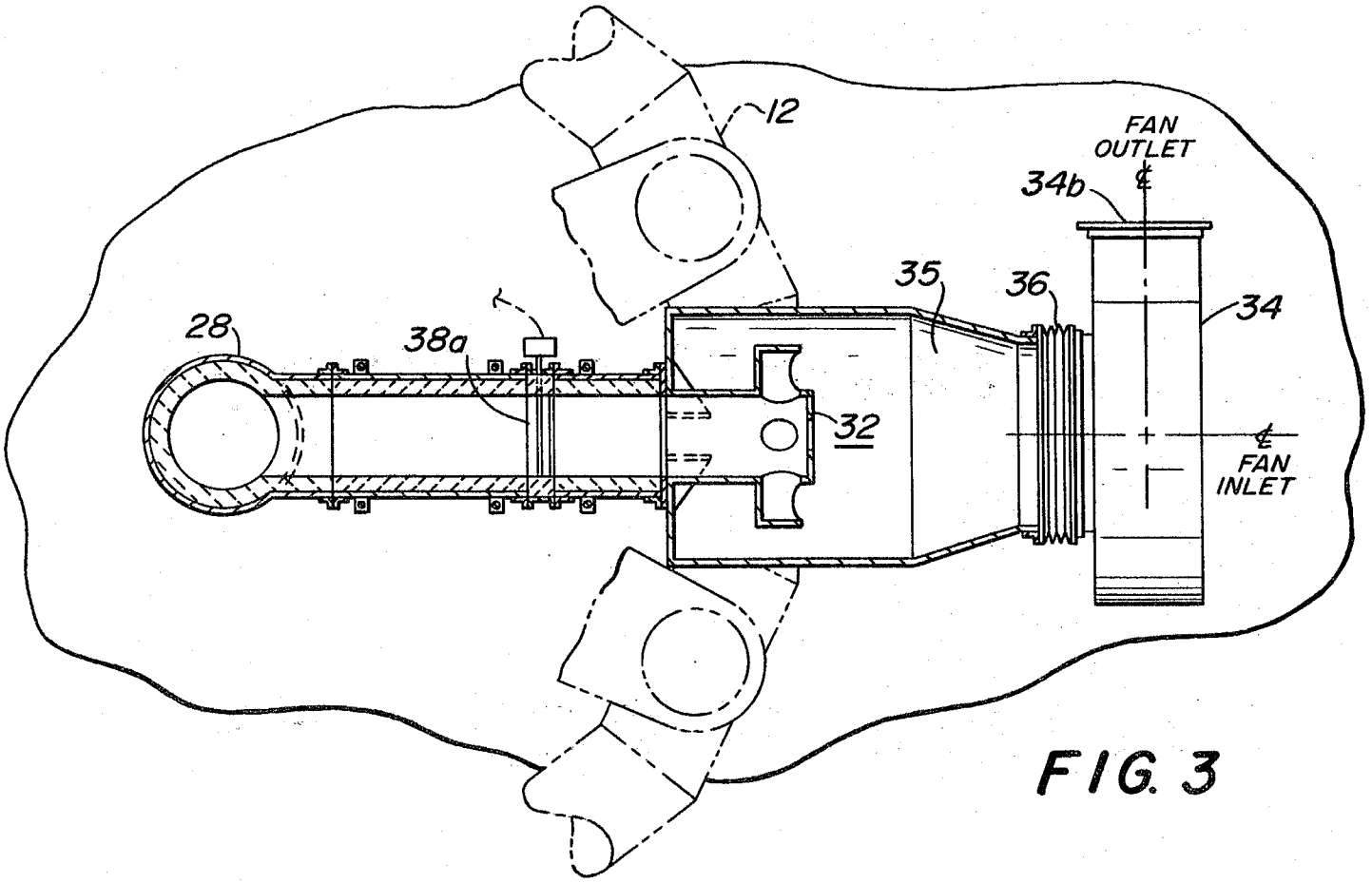
FIG. 3 is a sectional view of part of the apparatus shown in FIG. 2 taken along section line 3—3 in the direction indicated.

In accordance with the form of the present invention seen in FIGS. 2, 3, and 4, the system is provided with means for controlling the upper limit of the temperature within the central combustion zone 20 by extracting some of the gases therein as a direct function of the temperature. In the present invention, this is done by extracting super-heated gases from the zone 20 and applying them directly to the system exhaust, by-passing the outlet heat-exchange sections 16.

The central chamber 20 has a floor 30 which may have a generally concave contour as shown. Coupled thereto is a refractory-lined bypass duct 28 whose upper end communicates with the interior of zone 20 by an aperture formed in the floor 30. A heat-sensor indicated generally at numeral 29 is disposed in the vertical wall of conduit 28 near the aperture in the floor 30. It could alternatively be located in the chamber 20, as in the dome 25, for example. Wires 41 (schematically shown) run from the sensor 29 to a valve operator indicated at the numeral 38 which turns a disc valve 38*a* to regulate the flow of the extracted gas. An exhaust fan 34 is coupled via mixing chamber 37 to the horizontal part of the duct 28. The superheated gases are dispersed within the cooled exhaust gases from exhaust ring 12 by a gas distributor 32 within the mixing chamber 37 which communicates with the toroidal exhaust duct 12 via junction 39. Distributor 32 has a vertical face having a central aperture 32*a*, a somewhat cylindrical section 32*b* having a plurality of tubular projections 32*e* extending therefrom, and a smaller cylindrical tubular section 32*f*. Each projection 32*e* communicates with section 32*f* and has an aperture 32*d*. Angular support members 32*c* are mounted to brace section 32*f*.

The sensor 29 may be set so as to maintain a temperature in the zone 20 of 1400°–1500° F. so that when the valve 38*a* controlled thereby is open, gas coming through the valve is at or above that temperature range. In mixing chamber 37, the superheated gas is mixed with non-bypassed exhaust gases from exhaust ring 12 at about 320° F., for example, because they have lost most of their heat in passage outwardly from chamber 20 through one or more of the heat-exchange beds 17 acting in an outlet mode. The mixed, cooled exhaust gases pass out of the system through transition duct 35 and junction 36 to exhaust fan 34 having an outlet 36 which is coupled to a stack, for example.

In apparatus of the type shown, the nominal retention time of the gases to be purified is on the order of 2 seconds so that the extracted superheated gas which is bypassed is likely to have been in the 1400°–1500° F. range for at least one second. Thus, before being bypassed, the superheated gas has already reached a high degree of purification before being mixed with the normal exhaust gases in the chamber 37.

Due to the mixture of the superheated bypassed gases with the relatively cool normal exhaust gases, the gas sucked out through the exhaust fan 34 is at a relatively low uniform temperature so that potential damage to ducts, the fan and associated valves is considerably reduced.

Of course, many variations are possible. For example, the entire extraction of the bypassed gases could be effected at other places in the central chamber. One or more of the bypass ducts could be in communication with the dome-like roof 25 of the chamber via appropriate apertures formed therein or could even be in communication with the side walls of the chamber 20.

FIGS. 5–7 show another form of the invention which possesses some advantage over the form shown in FIGS. 1–4. In the latter, it is seen that the bypass duct 28 has a vertical section and a horizontal section which together constitute a rather large run of duct requiring refractory lining. Such lining is expensive so the form shown in FIGS. 5–7 has been devised. Parts similar to those in FIGS. 1–4 bear corresponding numbers which have been primed. There the refractory-lined run 28' has been considerably shortened before it enters the mixing chamber 37'. Consequently, although a duct 40 is required to connect the output of the chamber 37' to the exhaust fan 34', it need not be refractory-lined. The temperature of the gases carried through duct 40 are well below the 1400°–1500° F. range of the gases extracted from the combustion zone which pass through the refractory-lined duct 28'. To vary the rate at which the exhaust is drawn into the fan 34' louver-type valves 42 may be disposed within duct 40 near the inlet to fan 34'. The cooled exhaust and the extracted superheated gases are combined in the mixer-distributor 31 which is generally cylindrical and has a bore the same as the bore of duct 28' with which it communicates. It has a plurality of tubes 31*a* projecting laterally outward as well as apertures 31*b* formed in its side wall to promote thorough, quick and intimate mixing of the two gases before exit via the fan 34' to the stack.

While the above-described invention has been explained in connection with thermal regeneration incineration systems, it has application to other types also. For example, it could also be used in so-called thermal recuperation incineration apparatus in which there is but one heat-exchange section and a communicating combustion or oxidizing chamber. In such systems, the effluent is preheated in the heat-exchange section then passed into the combustion chamber where it is thermally decomposed and then is passed through the same section where it loses most of its heat and is drawn out by an exhaust fan to a stack or equivalent. Should the temperature of the combustion chamber become excessively high, a portion of the gases therein could similarly be extracted before returning through the same section and be applied directly to exhaust.

Still other arrangements are possible within the scope of the present invention as may be seen by one skilled in the art upon perusal of the specification, drawings and claims herein.

I claim:

1. In a thermal regeneration system for processing an industrial exhaust gas flow or the like, the combination comprising:

(a) a combustion chamber in which a high temperature range is maintained, (b) at least three separate stationary heat-exchange sections contiguous with and in communication with said chamber, each bed containing randomly disposed packing comprised of a plurality of solid heat exchange elements, said beds being bounded by vertical non-parallel walls, (c) a plurality of stationary inlet means, each being coupled to one of said beds, for conducting said gas flow to said bed for passage through it into said chamber, (d) a plurality of stationary outlet means, each coupled to one of said beds, for conducting said gas flow away from said bed after the gas flow has passed outwardly through said bed from said chamber, (e) fueled heating means within said chamber for continuously producing or maintaining said high temperature range, said temperature range being considerably higher than the temperature range of the gas flow as it first is applied to the apparatus and sufficiently high to cause continuous thermal oxidation of said gas flow, (f) means for sensing a predetermined temperature within said combustion chamber, and (g) means coupled to said chamber and to said sensing means for extracting a predetermined portion of the gases direct from said chamber when said sensing means detects said predetermined temperature, and (h) means coupled to said extracting means for mixing said extracted portion of gases with other gases from said exhaust which have been cooled by contact with at least one of said heat-exchange sections.

2. In the system according to claim 1 wherein said extracting means includes a conduit disposed to communicate with the interior of said chamber.

3. In the system according to claim 2, wherein said sensing means is disposed at least partially within said conduit.

4. In the combination according to claim 3, wherein valve means coupled to said sensing means are disposed within said conduit downstream of said sensing means and wherein the opening of said valve means is a direct function of the heat detected by said sensing means.

5. In the combination according to claim 2, wherein said mixing means includes a mixing chamber coupled to said conduit and to said exhaust, said mixing chamber also including means for distributing said extracted portion of gases substantially uniformly in the flow of gases in said exhaust.

6. In the combination according to claim 5 wherein said exhaust means includes a fan coupled to said mixing chamber for drawing said mixed gases therefrom.

7. In the combination according to claim 2 wherein said conduit means is refractory lined.

8. In the combination according to claim 2 wherein said conduit means communicates with the interior of said chamber via an opening in the bottom thereof.

9. In the combination according to claim 8 wherein said conduit is vertical and refractory lined and is connected directly to said mixing chamber and wherein said mixing chamber is also connected to said exhaust means by additional conduits which are not refractory lined.

10. In the combination according to claim 8 wherein said exhaust means includes a ring-like exhaust duct communicating with said heat-exchange sections and also includes an exhaust fan, and further wherein said mixing means is directly connected to said vertical conduit and is coupled by substantially horizontal conduits to said exhaust duct and to said fan, said horizontal conduits not being refractory lined.

11. In the combination according to claim 8 wherein said conduit comprises a vertical section and a horizontal section both of which are refractory lined.

12. In the combination according to claim 11 wherein said exhaust means includes a ring-like exhaust duct communicating with said heat-exchange sections and an exhaust fan, and wherein said mixing means is coupled to said horizontal section and to said ring-like duct, said fan being provided to draw gases through said vertical section and said ring-like duct into said mixing means and therefrom.

13. In thermal regeneration apparatus for processing an industrial exhaust gas flow or the like having three heat-exchange sections communicating with a high temperature combustion chamber and exhaust means, the heat controlling apparatus comprising:

(a) a combustion chamber in which a high temperature range is maintained, (b) at least three separate stationary heat-exchange sections contiguous with and in communication with said chamber, each bed containing randomly disposed packing comprised of a plurality of solid heat exchange elements, said beds being bounded by vertical non-parallel walls, (c) a plurality of stationary inlet means, each being coupled to one of said beds, for conducting said gas flow to said bed for passage through it into said chamber, (d) a plurality of stationary outlet means, each coupled to one of said beds, for conducting said gas flow away from said bed after the gas flow has passed outwardly through said bed from said chamber, (e) fueled heating means within said chamber for continuously producing or maintaining said high temperature range, said temperature range being considerably higher than the temperature range of the gas flow as it first is applied to the apparatus and sufficiently high to cause continuous thermal oxidation of said gas flow, (f) an aperture formed in said combustion chamber, (g) conduit means coupled to said aperture for communicating with the interior of said chamber, (h) means for sensing a predetermined temperature within said chamber, (i) means coupled to said sensing means, to said conduit means and to said exhaust means for mixing a predetermined portion of said products of combustion drawn from said conduit with products of combustion appearing in said exhaust means, and (j) means for disposing of said mixed combustion products.

14. The heat controlling apparatus according to claim 13 wherein said aperture is formed toward the bottom of said combustion chamber and wherein said sensing means is disposed at least partially within said conduit means near said aperture and further wherein valve means coupled to said sensing means is provided in said conduit means for regulating the amount of flow of said predetermined portion out of said combustion chamber.

* * * * *